US007898190B2

(12) United States Patent
Grabner

(10) Patent No.: US 7,898,190 B2
(45) Date of Patent: Mar. 1, 2011

(54) METHOD FOR SETTING AN ELECTRONIC BALLAST

(75) Inventor: Martin Grabner, Dietramszell (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 311 days.

(21) Appl. No.: 11/992,581

(22) PCT Filed: Sep. 26, 2006

(86) PCT No.: PCT/EP2006/066726

§ 371 (c)(1),
(2), (4) Date: Mar. 26, 2008

(87) PCT Pub. No.: WO2007/036514

PCT Pub. Date: Apr. 5, 2007

(65) Prior Publication Data

US 2009/0160366 A1 Jun. 25, 2009

(30) Foreign Application Priority Data

Sep. 28, 2005 (DE) ..... 10 2005 046 482

(51) Int. Cl.
*G05F 1/00* (2006.01)

(52) U.S. Cl. ..... 315/307; 315/310; 315/291

(58) Field of Classification Search ..... 315/291, 315/307, 306, 310

See application file for complete search history.

(56) References Cited

U.S. PATENT DOCUMENTS

| | | | | |
|---|---|---|---|---|
| 5,600,211 | A * | 2/1997 | Luger | 315/307 |
| 6,501,235 | B2 * | 12/2002 | Ortmeyer | 315/307 |
| 6,972,531 | B2 | 12/2005 | Krummel | |

FOREIGN PATENT DOCUMENTS

| | | | |
|---|---|---|---|
| EP | 1 235 468 | A2 | 8/2002 |
| EP | 1 519 638 | A1 | 3/2005 |
| WO | 02/49398 | A1 | 6/2002 |

* cited by examiner

*Primary Examiner* — Douglas W Owens
*Assistant Examiner* — Jianzi Chen

(57) ABSTRACT

Method for setting an electronic ballast, with which an electric lamp is operated which comprises programming first settings of at least one operational parameter of at least one first lamp type into the electronic ballast, setting and operating an electric lamp, which is connected to the electronic ballast, with the programmed first settings as long as a normal operating mode of the electronic ballast is set, changing the first settings of the operational parameters during a secondary operating mode of the electronic ballast, the secondary operating mode of the electronic ballast being set when the electronic ballast identifies a value for the resistance of a lamp filament and/or a substitute load of the electric lamp connected to the electronic ballast which is untypical in comparison with the normal operating mode, the change to the first settings being carried out depending on the identified untypical value for the corresponding resistance.

10 Claims, No Drawings

METHOD FOR SETTING AN ELECTRONIC BALLAST

TECHNICAL FIELD

The present invention relates to a method for setting an electronic ballast, with which an electric lamp is operated.

PRIOR ART

Electronic ballasts are used for setting and operating electric lamps. Since there is a large number of different types of lamp, it is in principle also necessary for a relatively high number of electronic ballasts to be provided in order to be able to operate the different types of electric lamps. In order to be able to reduce this high number of different electronic ballasts, electronic ballasts are known which can be used for a plurality of different lamp types. However, in this case it is necessary for the electronic ballast to identify, if possible automatically, which lamp type is connected and then to set the suitable operating conditions. In this case, it is critical to precisely set, inter alia, the preheating current, the lamp current, the operating voltage and further appropriate operational parameters.

In known electronic ballasts which are designed to operate a plurality of different lamp types, the resistances of the lamp filaments and the electric lamp are measured during operation, and the suitable operational parameters are determined from these values using an internally stored table. Owing to the similarity between the operational parameters of the different lamp types and the large tolerances involved, however, errors often arise when identifying the connected lamp type. As a result, it is possible for the electric lamp which is connected to the electronic ballast to be set and operated only relatively insufficiently. The operation of the electric lamp is inefficient and ineffective. Furthermore, it may also arise that the electric lamps wear relatively rapidly or have a defect in the case of such inaccurate and erroneous settings of the operational parameters.

DESCRIPTION OF THE INVENTION

The present invention is therefore based on the object of being able to provide a method for setting an electronic ballast, with which method an electronic ballast can be operated for a plurality of different electric lamps and it is possible for the electric lamps to be set and operated very precisely.

This object is achieved by a method having the features of patent claim 1.

A method according to the invention for setting an electronic ballast, with which at least two electric lamps of different lamp types can be operated, has the following steps:

a) programming first settings of at least one operational parameter of at least one electric lamp of a first lamp type into the electronic ballast;

b) setting and operating an electric lamp of the first lamp type, which electric lamp is connected to the electronic ballast, with the programmed first settings as long as a normal operating mode of the electronic ballast is set; and c) changing the first settings of the operational parameters during a secondary operating mode of the electronic ballast, the secondary operating mode of the electronic ballast being set when the electronic ballast identifies a value for the resistance of a lamp filament and/or a value for a substitute load of an electric lamp connected to the electronic ballast which exceeds a respectively predeterminable corresponding threshold value, a respective threshold value characterizing a value for the resistance of a lamp filament and/or for a substitute load of the electric lamp connected to the electronic ballast which is untypical in comparison with the normal operating mode, and the change to the first settings being carried out depending on the identified untypical value for the corresponding resistance.

It is possible by means of the method according to the invention for a plurality of different electric lamps and therefore different lamp types to be set and operated in a simple and low-complexity manner using one electronic ballast. Furthermore, it is possible to ensure that a plurality of different electric lamps of different lamp types can be operated safely and precisely. As a result, the life may be increased and costs reduced. Simply setting the electronic ballast to a different lamp type can only take place in the secondary operating mode, as a result of which an undesirable or unnoticed change to the settings can be prevented. The electronic ballast can clearly identify abnormal values which exceed a threshold value for a resistance for a lamp filament and/or a threshold value for a substitute load of a conventional electric lamp. The electronic ballast is therefore prevented from automatically carrying out a change to the settings if it purportedly supposes another lamp type on the basis of fluctuations in the operational parameters. With the changed settings in the secondary operating mode, an electric lamp of another lamp type can then again be operated in optimum fashion.

The changed settings are advantageously programmed in the electronic ballast, the electronic ballast changing back to the normal operating mode when the electronic ballast identifies a value which is below the threshold value and which characterizes a value, which is again typical in comparison with the normal operating mode, for the resistance of a lamp filament of the electric lamp and/or a substitute load of the electric lamp. The changeover between a normal operating mode and a secondary operating mode and therefore the changing of settings is as a result carried out in a reliable and controllable manner.

The changed settings of the electronic ballast are preferably used until a further reprogramming is carried out during a secondary operating mode.

The threshold value is advantageously at least a factor of 2, in particular at least a factor of 4, in particular at least a factor of 8, in particular at least a factor of 10, greater than a value for the resistance of a conventional lamp filament. In order to be able to safely introduce the secondary operating mode, the threshold value is set such that it markedly exceeds a customary value during conventional, correct operation of an electric lamp.

In step c), the electric lamp operated by the electronic ballast is preferably isolated from the electronic ballast and a programming lamp is electrically connected to the electronic ballast for the purpose of setting the secondary operating mode, the value for the resistance of the lamp filament of the programming lamp and/or the value for the resistance of the substitute load of the programming lamp having a value which is untypical in comparison with an electric lamp, the values being greater than corresponding threshold values. A simple programming lamp makes it possible to bring about a secondary operating mode of an electronic ballast rapidly and with little complexity.

The threshold value for the resistance of the lamp filament is preferably set to be greater than 100 ohms, in particular greater than 200 ohms.

Provision may be made for the threshold value for the resistance of the substitute load of the electric lamp to be greater than 800 ohms, in particular greater than 1 kohm.

Individual values for settings of the operational parameters are advantageously correlated with each untypical value for the resistance of the lamp filament and/or each untypical value for the resistance of the substitute load of the electric lamp. The electronic ballast preferably identifies the size of the untypical value in the secondary operating mode and, on the basis of this, the first settings of the at least one operational parameter are changed as regards the settings of the operational parameter which are correlated with the identified untypical value. As a result, it is possible to carry out very precise setting of the operational parameters of the different electric lamps since, even when the different electric lamps have very similar or even overlapping operational parameter values or operational parameter ranges, it is possible to precisely set and program the required values for each individual lamp.

Provision may be made for at least two programming lamps to be provided, the values for the resistances of the lamp filaments and/or the substitute loads differing such that the corresponding values are identified by the electronic ballast without any errors.

Provision may also advantageously be made for the secondary operating mode of the electronic ballast to be set when the value for the resistance of the lamp filament and/or the value for the resistance of the substitute load is within a resistance interval. In this case, the lower interval limit is formed by the threshold value, which represents an untypical value for this or these abovementioned resistances (lamp filament and/or substitute load). The upper limit of the interval is in this case formed by such a value which is below a resistance value for a defective lamp and/or a broken lamp filament. This makes it possible to prevent a secondary operating mode of the electronic ballast being set in an undesirable manner when the lamp is defective and/or the lamp filament is broken, owing to the high resistance value detected in this case.

PREFERRED EMBODIMENT OF THE INVENTION

In the method according to the invention for setting an electronic ballast, a basic setting of the electronic ballast is carried out by the manufacturer of the luminaire or the manufacturer of the electronic ballast. A first basic setting of the electronic ballast is in this case carried out such that first settings of at least one operational parameter are programmed into the electronic ballast. These first settings of at least one operational parameter are in this case programmed in with regard to which first lamp type is intended to be set and operated by the electronic ballast. The basic setting of the electronic ballast therefore takes place in a customer-specific manner as regards the desired lamp type which is initially intended to be operated using the electronic ballast. For example, a preheating current and/or a lamp current and/or an operating voltage can be regarded as operational parameters. However, these are only exemplary data for operational parameters which can be supplemented and extended in a variety of ways as regards the invention. In principle, all operational parameters are included which are required and are useful for reliable and correct operation of an electric lamp using the electronic ballast.

The electronic ballast provided in the basic setting may subsequently be connected to the corresponding first electric lamp of the first lamp type, the corresponding first settings being programmed and stored in the electronic ballast for the optimum operation of this lamp type.

Such an operation of an electric lamp with the programmed first settings of at least one operational parameter in the electronic ballast is referred to as the normal operating mode of the electronic ballast. If another second electric lamp is intended to be operated using the electronic ballast, which second electric lamp, however, characterizes another second lamp type and therefore requires different settings of at least one operational parameter, it is necessary for this basic setting of the electronic ballast to be changed. For this purpose it is necessary for the first settings of the operational parameters to be changed and therefore for the electronic ballast to be reprogrammed. Such a change to the first settings of the operational parameters is carried out during a secondary operating mode of the electronic ballast. The secondary operating mode of the electronic ballast is characterized by the fact that, or is set when, the electronic ballast identifies a value for the resistance of a lamp filament of the electric lamp which is untypical in comparison with the normal operating mode and/or an untypical value for a substitute load of the electric lamp. The untypical value is characterized by the fact that it is greater than a predeterminable threshold value. In this case, the threshold value is set such that its value does not occur during error-free operation and in particular in the normal operating mode of the electronic ballast since an electric lamp envisaged for actual operation is not designed or produced with lamp filaments and/or substitute loads which have values which come close to or exceed these threshold values.

In the exemplary embodiment, the electric lamp of a first lamp type is isolated from the electronic ballast for the purpose of bringing about the secondary operating mode of the electronic ballast by the electric lamp being removed from the lampholder for a short period of time. In place of this, a programming lamp is inserted into the lampholder and is electrically connected to the electronic ballast. The programming lamp is in this case designed such that the lamp filament of the programming lamp, referred to below as the programming filament, has an untypical value for the resistance. In the exemplary embodiment, the value for the resistance of the programming filament is greater than 200 ohms, the value of 200 ohms being the threshold value. This value denotes an absolutely untypical value for the resistance of a lamp filament since, in the case of conventional lamps which are used during operation, the value for the resistance of a lamp filament is up to a few or a few tens of ohms.

Provision may also be made for the value for the resistance of a substitute load of the electric lamp to be identified by the electronic ballast in place of or in addition to the value for the resistance of a lamp filament and, on the basis of this, for a normal operating mode or a secondary operating mode to be set. In this case, provision is also made for the electronic ballast to change over to the secondary operating mode in the case of a value for the resistance of the substitute load of the electric lamp which is untypical in comparison with the normal operating mode.

The electronic ballast therefore only changes over from the normal operating mode to the secondary operating mode if it detects an absolutely unrealistic value for the value for the resistance of the lamp filament and/or the value for a substitute load of the electric lamp. Only in this secondary operating mode of the electronic ballast can the first settings of at least one operational parameter be changed and the electronic ballast reprogrammed.

Depending on the size of the untypical value for the resistance of the programming filament, the electronic ballast may reset the operational parameters and change the first settings of the operational parameters. In this case, provision is made for the individual untypical value for the resistance of the programming filament to be correlated with the new settings of the operational parameters. This means that special individual values, for example for the preheating current and/or the lamp current and/or the operating voltage of a further second lamp type, are associated with this special value, which in the exemplary embodiment is, for example, 300 ohms. The electronic ballast can therefore identify, merely on the basis of the detected untypical value for the resistance of the programming filament, how the first settings of the operational parameters should be changed and, as a consequence, how the electronic ballast should be reprogrammed in order to be able to set and operate, in optimum fashion, an electric lamp of a second lamp type.

Provision may also be made for a further programming filament or a further programming substitute load, which represents a substitute load of the electric lamp, to be provided which differs from the untypical value mentioned above. For example, in this case provision may be made for a further programming filament to be provided which has a value for the resistance of 600 ohms. The electronic ballast can precisely detect even this value of 600 ohms and set and change the operational parameters in a manner which is associated or correlated with this further value, which setting or change is required, for example, for the optimized operation of an electric lamp of a third lamp type.

By relatively large differences as regards the values for the resistances being prescribed for the programming filaments or the programming substitute loads, it is possible to achieve a situation in which, owing to the large graduations in and discrepancies between these untypical values in relation to one another, reliable identification of the size of these values can be ensured by the electronic ballast. As a result, it is further advantageously possible to achieve a situation in which the settings, which are in each case associated with these untypical values, of at least one operational parameter can be carried out such that these respectively associated values can be relatively close to one another. This makes it possible to achieve a situation in which the operation and setting of two different electric lamps of different lamp types, which have, however, for example a relatively similar preheating current for optimum operation, can be carried out in a reliable manner.

This is because these virtually identical values for the preheating currents of these two different electric lamps can be associated with programming filaments which in each case have an untypical value for the resistance of these programming filaments, which differ from one another to a relatively severe extent, for example 300 ohms and 600 ohms. For example, this difference between the untypical values can be detected clearly by the electronic ballast, and therefore even the settings, which are used as the basis and are correlated with these untypical values, of at least one operational parameter can be set precisely and rapidly, as a result of which optimum operation and optimum setting of the electric lamp can be carried out.

The electronic ballast only changes back to the normal operating mode when the programming lamp has been removed from the lampholder again and the electric lamp of the second lamp type has been correctly inserted for further operation. The further normal operating mode of the electronic ballast is then carried out with the unprogrammed data set and therefore the electric lamp of the second lamp type is operated with the new settings of the operational parameters.

Provision may be made for the untypical values for the resistance of a lamp filament of the electric lamp and/or the untypical values for a substitute load of the electric lamp to be correlated with settings, in particular new settings, of at least one operational parameter and for the new settings to be taken from the correlation table stored in the secondary operating mode of the electronic ballast. However, provision may also be made for the settings, which are correlated with these untypical values, of at least one operational parameter to subsequently be transferred to the electronic ballast once the untypical value has been identified.

The operational parameters may be coded in the value for the resistance of the lamp filament and/or in the value for the substitute load of the electric lamp with such large graduations that error-free identification of the operational parameters is ensured.

The entire illumination system, which comprises the electronic ballast and the at least one electric lamp, is preferably also further-operated during the entire process for reprogramming and changing the first settings of the operational parameters and therefore also in the secondary operating mode of the electronic ballast, in the switched-on state.

The invention claimed is:

1. A method for setting an electronic ballast, with which at least two electric lamps of different lamp types can be operated and which has the following steps:

a) programming first settings of at least one operational parameter of at least one electric lamp of a first lamp type into the electronic ballast;

b) setting and operating an electric lamp of the first lamp type, which electric lamp is connected to the electronic ballast, with the programmed first settings as long as a normal operating mode of the electronic ballast is set;

c) changing the first settings of the operational parameters during a secondary operating mode of the electronic ballast, the secondary operating mode of the electronic ballast being set when the electronic ballast identifies a value for the resistance of a lamp filament and/or a value for a substitute load of an electric lamp connected to the electronic ballast which exceeds a respectively predeterminable corresponding threshold value, a respective threshold value characterizing a value for the resistance of a lamp filament and/or for a substitute load of the electric lamp connected to the electronic ballast which is untypical in comparison with the normal operating mode, and the change to the first settings being carried out depending on the identified untypical value for the corresponding resistance;

and further wherein in step c), the electric lamp operated by the electronic ballast is isolated from the electronic ballast and a programming lamp is electrically connected to the electronic ballast for the purpose of setting the secondary operating mode, the value for the resistance of the lamp filament of the programming lamp and/or the value for the resistance of the substitute load of the programming lamp having a value which is untypical in comparison with an electric lamp and which is greater than corresponding threshold values.

2. The method as claimed in claim 1, wherein the changed settings are programmed in the electronic ballast, and the electronic ballast changes back to the normal operating mode when the electronic ballast identifies a value which is below the threshold value and which characterizes a value, which is again typical in comparison with the normal operating mode, for the resistance of a lamp filament of the electric lamp and/or a substitute load of the electric lamp.

3. A method for setting an electronic ballast, with which at least two electric lamps of different lamp types can be operated and which has the following steps:

a) programming first settings of at least one operational parameter of at least one electric lamp of a first lamp type into the electronic ballast;

b) setting and operating an electric lamp of the first lamp type, which electric lamp is connected to the electronic ballast, with the programmed first settings as long as a normal operating mode of the electronic ballast is set;

c) changing the first settings of the operational parameters during a secondary operating mode of the electronic ballast, the secondary operating mode of the electronic ballast being set when the electronic ballast identifies a value for the resistance of a lamp filament and/or a value for a substitute load of an electric lamp connected to the electronic ballast which exceeds a respectively predeterminable corresponding threshold value, a respective threshold value characterizing a value for the resistance of a lamp filament and/or for a substitute load of the electric lamp connected to the electronic ballast which is untypical in comparison with the normal operating mode, and the change to the first settings being carried out depending on the identified untypical value for the corresponding resistance;

and further wherein the threshold value for the resistance of the lamp filament is greater than 100 ohms, in particular greater than 200 ohms.

4. The method as claimed in claim 3, wherein the changed settings are programmed in the electronic ballast, and the electronic ballast changes back to the normal operating mode when the electronic ballast identifies a value which is below the threshold value and which characterizes a value, which is again typical in comparison with the normal operating mode, for the resistance of a lamp filament of the electric lamp and/or a substitute load of the electric lamp.

5. A method for setting an electronic ballast, with which at least two electric lamps of different lamp types can be operated and which has the following steps:

a) programming first settings of at least one operational parameter of at least one electric lamp of a first lamp type into the electronic ballast;

b) setting and operating an electric lamp of the first lamp type, which electric lamp is connected to the electronic ballast, with the programmed first settings as long as a normal operating mode of the electronic ballast is set;

c) changing the first settings of the operational parameters during a secondary operating mode of the electronic ballast, the secondary operating mode of the electronic ballast being set when the electronic ballast identifies a value for the resistance of a lamp filament and/or a value for a substitute load of an electric lamp connected to the electronic ballast which exceeds a respectively predeterminable corresponding threshold value, a respective threshold value characterizing a value for the resistance of a lamp filament and/or for a substitute load of the electric lamp connected to the electronic ballast which is untypical in comparison with the normal operating mode, and the change to the first settings being carried out depending on the identified untypical value for the corresponding resistance;

and further wherein the threshold value for the resistance of the substitute load of the electric lamp is greater than 800 ohms, in particular greater than 1 k ohm.

6. The method as claimed in claim 5, wherein the changed settings are programmed in the electronic ballast, and the electronic ballast changes back to the normal operating mode when the electronic ballast identifies a value which is below the threshold value and which characterizes a value, which is again typical in comparison with the normal operating mode, for the resistance of a lamp filament of the electric lamp and/or a substitute load of the electric lamp.

7. A method for setting an electronic ballast, with which at least two electric lamps of different lamp types can be operated and which has the following steps:

a) programming first settings of at least one operational parameter of at least one electric lamp of a first lamp type into the electronic ballast;

b) setting and operating an electric lamp of the first lamp type, which electric lamp is connected to the electronic ballast, with the programmed first settings as long as a normal operating mode of the electronic ballast is set;

c) changing the first settings of the operational parameters during a secondary operating mode of the electronic ballast, the secondary operating mode of the electronic ballast being set when the electronic ballast identifies a value for the resistance of a lamp filament and/or a value for a substitute load of an electric lamp connected to the electronic ballast which exceeds a respectively predeterminable corresponding threshold value, a respective threshold value characterizing a value for the resistance of a lamp filament and/or for a substitute load of the electric lamp connected to the electronic ballast which is untypical in comparison with the normal operating mode, and the change to the first settings being carried out depending on the identified untypical value for the corresponding resistance;

and further wherein individual values for settings of the operational parameters are correlated with each untypical value for the resistance of the lamp filament and/or each untypical value for the resistance of the substitute load of the electric lamp.

8. The method as claimed in claim 7, wherein the electronic ballast identifies the size of the untypical value in the secondary operating mode and, on the basis of this, the first settings of the at least one operational parameter are changed as regards the settings of the operational parameter which are correlated with the identified untypical value.

9. The method as claimed in claim 7, wherein the changed settings are programmed in the electronic ballast, and the electronic ballast changes back to the normal operating mode when the electronic ballast identifies a value which is below the threshold value and which characterizes a value, which is again typical in comparison with the normal operating mode, for the resistance of a lamp filament of the electric lamp and/or a substitute load of the electric lamp.

10. A method for setting an electronic ballast, with which at least two electric lamps of different lamp types can be operated and which has the following steps:

programming first settings of at least one operational parameter of at least one electric lamp of a first lamp type into the electronic ballast;

b) setting and operating an electric lamp of the first lamp type, which electric lamp is connected to the electronic ballast, with the programmed first settings as long as a normal operating mode of the electronic ballast is set;

c) changing the first settings of the operational parameters during a secondary operating mode of the electronic ballast, the secondary operating mode of the electronic ballast being set when the electronic ballast identifies a value for the resistance of a lamp filament and/or a value for a substitute load of an electric lamp connected to the electronic ballast which exceeds a respectively predeterminable corresponding threshold value, a respective threshold value characterizing a value for the resistance of a lamp filament and/or for a substitute load of the electric lamp connected to the electronic ballast which is untypical in comparison with the normal operating mode, and the change to the first settings being carried out depending on the identified untypical value for the corresponding resistance;

and further wherein the threshold value is at least a factor of 2 greater than a value for the resistance of the lamp filament in the normal operating mode;

and further wherein at least two programming lamps are provided, the values for the resistances of the lamp filaments and/or the substitute loads differing such that the corresponding values are identified by the electronic ballast without any errors.

* * * * *